United States Patent [19]

Lipp

[11] 4,225,846

[45] Sep. 30, 1980

[54] SHAFT LOCKING MECHANISM HAVING COMBINATION SWITCH AND VARIABLE RESISTOR

[75] Inventor: Ellis P. Lipp, Frankfort, Ind.

[73] Assignee: Emhart Industries, Inc., Indianapolis, Ind.

[21] Appl. No.: 8,601

[22] Filed: Feb. 1, 1979

[51] Int. Cl.[3] ..... H01C 10/50

[52] U.S. Cl. ..... 338/198; 338/200

[58] Field of Search ..... 338/198, 200, 191, 172, 338/174, 130–132, 135

[56] References Cited

U.S. PATENT DOCUMENTS

| | | | |
|---|---|---|---|
| 3,023,388 | 2/1962 | DiGirolamo et al. | 338/172 |
| 3,139,769 | 7/1964 | Gauchat | 338/130 X |
| 3,602,868 | 8/1971 | Lybrook | 338/172 X |
| 3,697,921 | 10/1972 | Urwin | 338/131 |
| 3,924,220 | 12/1975 | Matsui et al. | 338/172 |
| 3,927,276 | 12/1975 | Lipp | 338/172 X |

*Primary Examiner*—C. L. Albritton

*Attorney, Agent, or Firm*—Hoffmann & Meyer

[57] ABSTRACT

A rotatable shaft for a combination switch and variable resistor is prevented from rotating by a shaft locking mechanism. The locking mechanism includes cooperating grooves and a tab engaging the grooves. The shaft is axially moved to be put in a rotatable position.

4 Claims, 2 Drawing Figures

SHAFT LOCKING MECHANISM HAVING COMBINATION SWITCH AND VARIABLE RESISTOR

BACKGROUND OF THE INVENTION

Generally speaking, the present invention relates to a shaft locking mechanism which comprises a frame having a pair of apertures therein, a shaft rotatably and axially movable in the apertures, and cooperating grooves and tab carried by the shaft and the frame whereby engagement of the tab with one of the grooves prevents shaft rotation and engagement of the tab with the other of the grooves permits shaft rotation.

In a combination of a switch and a variable resistor, axial movement of the shaft in a predetermined direction disengages the tab from one groove and engages the other groove to permit rotation of the shaft, rotation of the shaft engages an actuator means with a switch actuator means to open and close the switch and also varies the resistance of the variable resistor. Upon continued rotation, the tab is aligned with the first groove to permit the shaft to be axially moved to engage the same to prevent further rotation of the shaft.

The present invention pertains to a combination switch and variable resistor and more particularly to a shaft locking mechanism for a shaft used in such combination.

Rotary switches and variable resistors are used in appliances such as radios, TV's, and cooking appliances such as ovens to turn the appliance on or off and to vary the output of such appliance. In many of such applications the switch and the variable resistor are used in combination and operate off of a single shaft. In such applications, care must be taken to ensure that the switch cannot be accidentally turned on. More specifically, there needs to be a means that would require the operator of the appliance to delibrately turn the switch to the ON position. In oven applications for example, there should be a means to prevent the oven from being accidentally turned on and the power raised by a small child. The present invention, therefore, is concerned with a combination switch and variable resistor apparatus having a means to lock its shaft in a predetermined position.

OBJECTS OR FEATURES OF THE INVENTION

It is therefore a feature of the present invention to provide a shaft locking mechanism for a combination switch and variable resistor apparatus. Another feature of the invention is to provide such a mechanism wherein a shaft is rotatably and axially movable in a pair of apertures disposed within a frame. Another feature of the invention is to provide such a mechanism wherein there are cooperating grooves and a tab carried by the shaft and the frame. Still another feature of the invention is the provision of such a mechanism wherein engagement of the tab with one of the grooves prevents shaft rotation and engagement of the tab with the other of the grooves permits shaft rotation. Yet another feature of the invention is the provision of such a mechanism wherein there is a spring means biasing the shaft for axial movement. These and other features of the invention will become apparent from the following description taken in conjunction with the accompanying drawings.

DETAILED DESCRIPTION OF THE INVENTION

Figure 1:
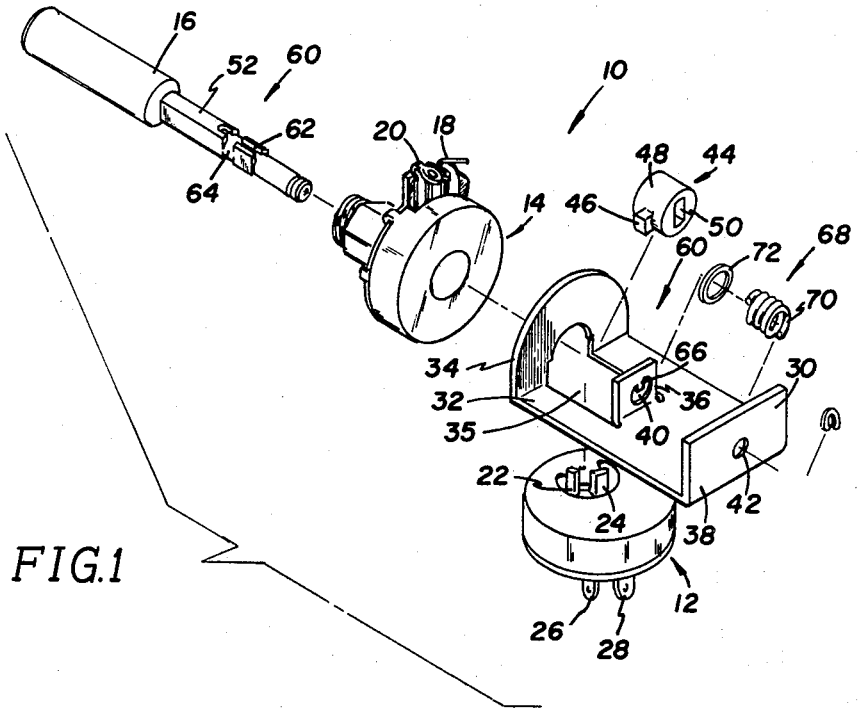
FIG. 1 is an exploded view of a combination switch and variable resistor apparatus employing the features of the invention.
Figure 2:
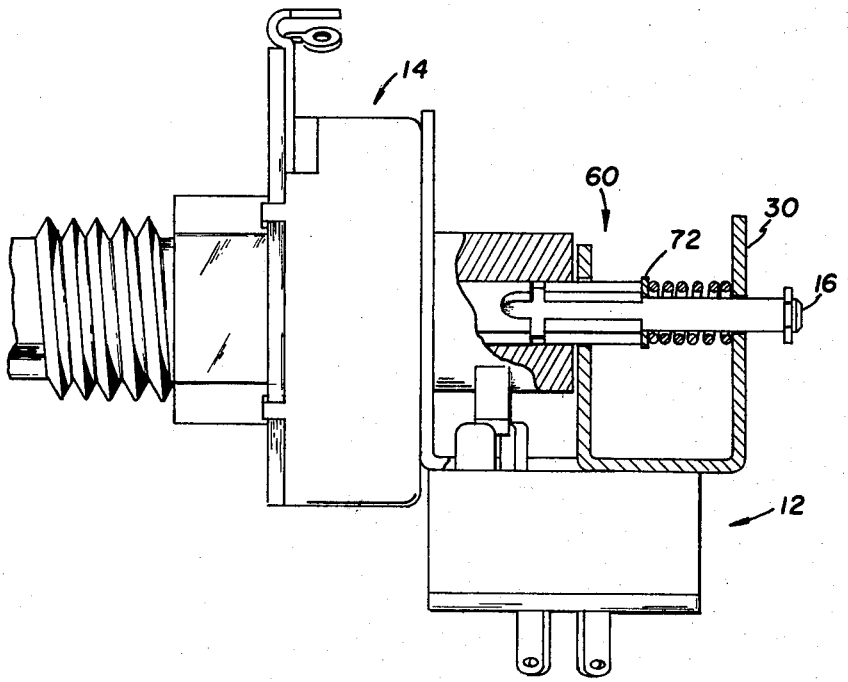
FIG. 2 is a partial section of the combination.

Referring now to the drawings, there is shown a combination switch and variable resistor apparatus 10 which in general includes a rotary switch 12 and a variable resistor 14 both of which are operable off of a shaft 16. The variable resistor is of the type commonly used in the art and although not shown includes a resistance path and acollector path with rotatable electrical contacts bridging the two to provide a rotatable variable output through electrical terminals 18 and 20. A typical variable resistor is shown and described in U.S. Pat. No. 3,691,504 which is incorporated herein by reference.

Switch 12 is of the rotary type described in U.S. Pat. No. 2,820,864 issued Jan. 21, 1958 which is incorporated herein by reference. The switch includes a switch actuator comprising a pair of lugs 22 and 24. Movement of the lugs opens and closes electrical contacts to open and close an electrical circuit through terminals 26 and 28. As shown, both the variable resistor 14 and rotary switch 12 are carried by a frame 30. Frame 30 includes a base member 32 and three upstanding legs 34, 36 and 38. The variable resistor 14 is secured to leg 34 and the switch to base member 32 by some suitable means. A pair of apertures 40 and 42 are provided in legs 36 and 38. Shaft 16 is axially carried and rotatably journalled in the apertures. Rotation of the shaft causes rotation of the electrical contacts of variable resistor 14 and further causes actuation of rotary switch 12 through actuator means 44. Actuator means 44 includes a tab 46 extending from collar 48 which is fixedly held on the shaft 16 through double-D portion 52 of the shaft 16. Rotation of the shaft causes tab 46 to alternately engage and move grooves 22 and 24 of the rotary switch through aperture 35 of base member 32.

According to the present invention, a shaft lock mechanism 60 is provided to prevent rotation of the shaft when the shaft is in the OFF position with regard to the switch. Shaft locking mechanism 60 includes grooves 62 and 64 in shaft 16 and a tab 66 provided in aperture 40 cooperating therewith, and spring means 68 which axially biases the shaft in a predetermined direction. As shown, grooves 62 is cut in a longitudinal or axial direction of the shaft while groove 64 is cut around the periphery of the shaft in a direction substantially normal to the groove 62. Tab 66 and grooves 62 and 64 are movable with respect to each other by the tab being free to move within both of the grooves. Spring means 68 includes a coil spring 70 carried by and surrounding shaft 16, the spring being held in position by leg 30 and ring 72.

In operation, shaft 16 is in a normally locked position by the shaft being positioned such that tab 66 is in engagement groove 62. In this position the shaft cannot be rotated. Axial movement of the shaft 16 inward toward the variable-switch combination causes spring 60 to be compressed and permits tab 66 to engage groove 64. In this position shaft 16 may be rotated within the groove 64 to vary the resistance of variable resistor 14 and close rotary switch 12 through engagement of tab 46 with one of the lugs 22 or 24 of the switch. Further rotation of the shaft will cause tab 66 to become aligned with groove 62 to permit the tab to engage the groove when the shaft 16 is returned to its original position through coil spring 70. Also tab 46 engages the other lug of lugs 22 or 24 to open switch 12. Shaft 16 is again put in the locked position.

What is claimed is:

1. In a combination switch and variable resistor apparatus wherein rotation of shaft opens and closes said switch and varies a resistance of said variable resistor, a shaft locking and switching mechanism comprising:

(a) a frame having a pair of apertures therein, (b) a shaft rotatably and axially movable in said apertures, (c) cooperating first axial groove in said shaft, a second groove normal thereto in said shaft, and a tab carried by said frame, (d) actuator means coupled to said shaft engaging with actuator means of said switch, axial movement of said shaft in a predetermined direction disengaging said tab from said first groove and engaging said second groove to permit rotation of said shaft, rotation of said shaft engaging said actuator means with said switch actuator means and varying the resistance of said variable resistor, continued rotation causing said tab to align with said first groove to permit said shaft to be axially moved to engage same to prevent further rotation of said shaft.

2. The combination of claim 1 further including spring means axially biasing said shaft.

3. The combination of claim 2 wherein said spring means includes a coil spring surrounding and coupled to said shaft and biased against said frame.

4. The combination according to claim 1 wherein said actuator means is a tab extending from said shaft.

* * * * *